US009856867B2

(12) United States Patent
Kim et al.

(10) Patent No.: US 9,856,867 B2
(45) Date of Patent: Jan. 2, 2018

(54) LINEAR COMPRESSOR AND REFRIGERATOR CYCLE INCLUDING A LINEAR COMPRESSOR

(71) Applicant: LG ELECTRONICS INC., Seoul (KR)

(72) Inventors: Junghae Kim, Seoul (KR); Changkyu Kim, Seoul (KR); Youngcheol Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 253 days.

(21) Appl. No.: 14/686,831

(22) Filed: Apr. 15, 2015

(65) Prior Publication Data

US 2016/0017878 A1 Jan. 21, 2016

(30) Foreign Application Priority Data

Jul. 21, 2014 (KR) ..... 10-2014-0091830

(51) Int. Cl.
*F04B 39/12* (2006.01)
*F25B 31/02* (2006.01)
*F04B 35/04* (2006.01)

(52) U.S. Cl.
CPC ..... *F04B 39/121* (2013.01); *F04B 35/045* (2013.01); *F04B 39/123* (2013.01); *F04B 39/126* (2013.01); *F25B 31/023* (2013.01)

(58) Field of Classification Search
CPC .... F04B 35/045; F04B 39/121; F04B 39/123; F04B 39/126; F25B 31/023
See application file for complete search history.

(56) References Cited

U.S. PATENT DOCUMENTS 4,121,125 A * 10/1978 Dolz ..... H02K 33/18 310/27
5,704,771 A * 1/1998 Fujisawa ..... F04B 35/045 417/417

(Continued)

FOREIGN PATENT DOCUMENTS

CN 1749563 3/2006
EP 2 960 503 12/2015

(Continued)

OTHER PUBLICATIONS

European Search Report dated Dec. 9, 2015.

(Continued)

*Primary Examiner* — Devon Kramer
*Assistant Examiner* — Joseph Herrmann
(74) *Attorney, Agent, or Firm* — KED & Associates, LLP

(57) ABSTRACT

A linear compressor and a refrigerator including a linear compressor are provided. The linear compressor may include a shell coupled to a suction inlet, through which a refrigerant may be introduced, and a discharge outlet, through which the refrigerant may be discharged, a cylinder disposed within the shell to accommodate a piston reciprocated to compress the refrigerant introduced through the suction inlet, a frame that accommodates the cylinder, the frame being mounted inside the shell, and a discharge cover coupled to a front surface of the frame to discharge the refrigerant compressed by the piston to the discharge outlet. A front surface of the cylinder that faces the discharge cover may be spaced a predetermined distance from the discharged cover.

8 Claims, 9 Drawing Sheets

(56) References Cited

U.S. PATENT DOCUMENTS

| | | | | |
|---|---|---|---|---|
| 6,902,381 | B2 * | 6/2005 | Hur | F04B 39/14<br>417/570 |
| 7,249,938 | B2 * | 7/2007 | Noh | F04B 35/045<br>128/204.18 |
| 2006/0060196 | A1 | 3/2006 | Kim | |

FOREIGN PATENT DOCUMENTS

| | | |
|---|---|---|
| FR | 1 421 513 | 12/1965 |
| KR | 10-1307688 B1 | 9/2013 |
| WO | WO 2004/081378 | 9/2004 |

OTHER PUBLICATIONS

Chinese Office Action dated Dec. 26, 2016 issued in Application No. 201510279180.6 (English Translation attached).
European Office Action dated Mar. 1, 2017 issued in Application No. 15164401.0.

* cited by examiner

LINEAR COMPRESSOR AND REFRIGERATOR CYCLE INCLUDING A LINEAR COMPRESSOR

CROSS-REFERENCE TO RELATED APPLICATION(S)

This application claims priority under 35 U.S.C. §119 to Korean Application No. 10-2014-0091830 filed on Jul. 21, 2014, whose entire disclosure is hereby incorporated by reference.

BACKGROUND

1. Field

A linear compressor and a refrigeration system including a linear compressor are disclosed herein.

2. Background

In general, compressors are machines that receive power from a power generation device, such as an electric motor or turbine, to compress air, a refrigerant, or various working gases, thereby increasing in pressure. Compressors are being widely used in home appliances, such as refrigerators or air conditioners, or industrial fields.

Compressors may be largely classified into reciprocating compressors, in which a compression space into and from which a working gas is suctioned and discharged is defined between a piston and a cylinder to allow the piston to be linearly reciprocated in the cylinder, thereby compressing the working gas; rotary compressors, in which a compression space into and from which a working gas is suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned and discharged, is defined between an orbiting scroll and a fixed scroll to compress the working gas while the orbiting scroll rotates along the fixed scroll.

A linear compressor according to the related art is disclosed in Korean Patent Application No. 10-1307688, which is incorporated herein by reference. The related art linear compressor may suction and compress a working gas, such as a refrigerant, while a piston is linearly reciprocated in a sealed shell by a linear motor and then discharge the refrigerant. The linear motor is configured to allow a permanent magnet to be disposed between an inner stator and an outer stator. The permanent magnet may be linearly reciprocated by a mutual electromagnetic force between the permanent magnet and the inner (or outer) stator. As the permanent magnet operates in a state in which the permanent magnet is connected to the piston, the refrigerant may be suctioned and compressed while the piston is linearly reciprocated within the cylinder, and then, may be discharged.

In the linear compressor, a discharge cover to discharge the refrigerant to a discharge outlet metal-contacts a front surface of the cylinder to compress the cylinder. However, the compression of the cylinder by the discharge cover may cause deformation of an inner wall of the cylinder accommodating the piston.

BRIEF DESCRIPTION OF THE DRAWINGS

Embodiments will be described in detail with reference to the following drawings in which like reference numerals refer to like elements, and wherein.

DETAILED DESCRIPTION

Embodiments will be described below in more detail with reference to the accompanying drawings. The description is intended to be illustrative, and those with ordinary skill in the technical field pertains will understand that embodiments may be carried out in other specific forms without changing the technical idea or essential features. Also, for helping understanding, the drawings are not to actual scale, but are partially exaggerated in size.

Figure 1:
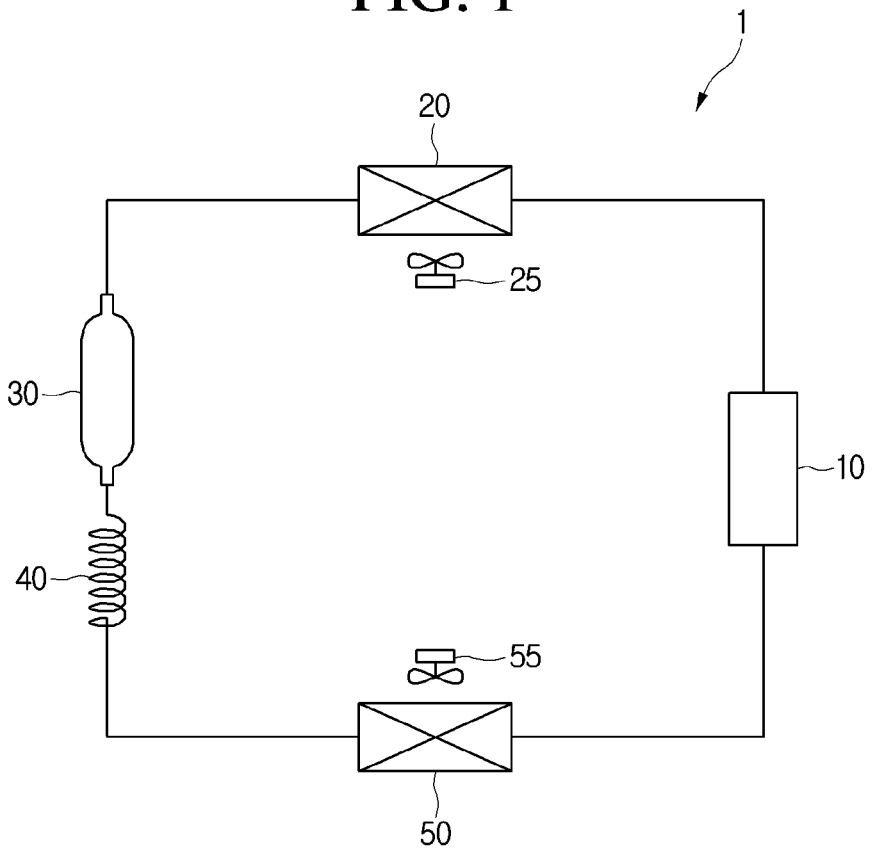
FIG. 1 is a schematic diagram of a refrigeration system according to an embodiment.

FIG. 1 is a schematic diagram of a refrigeration system according to an embodiment. Referring to FIG. 1, a refrigerator 1 according to an embodiment may include a plurality of devices to drive a refrigeration cycle.

In detail, the refrigerator 1 may include a compressor 10 to compress a refrigerant, a condenser 20 to condense the refrigerant compressed in the compressor 10, a dryer 30 to remove moisture, foreign substances, or oil from the refrigerant condensed in the condenser 20, an expansion device 40 to decompress the refrigerant passing through the dryer 30, and an evaporator 50 to evaporate the refrigerant decompressed in the expansion device 40. The refrigerator 1 may further include a condensation fan 25 to blow air toward the condenser 20, and an evaporation fan 55 to blow air toward the evaporator 50.

The compressor 10 may be a linear compressor that linearly reciprocates a piston directly connected to a motor within a cylinder to compress the refrigerant. Hereinafter, a linear compressor will be described as the compressor 10 according to this embodiment. The linear compressor 10 will be described in detail with reference to FIGS. 3 to 9.

The expansion device 40 may include a capillary tube having a relatively small diameter. A liquid refrigerant condensed in the condenser 20 may be introduced into the dryer 30. A gaseous refrigerant may be partially contained in the liquid refrigerant. A filter to filter the liquid refrigerant introduced into the dryer 30 may be provided in the dryer 30.

Figure 2:
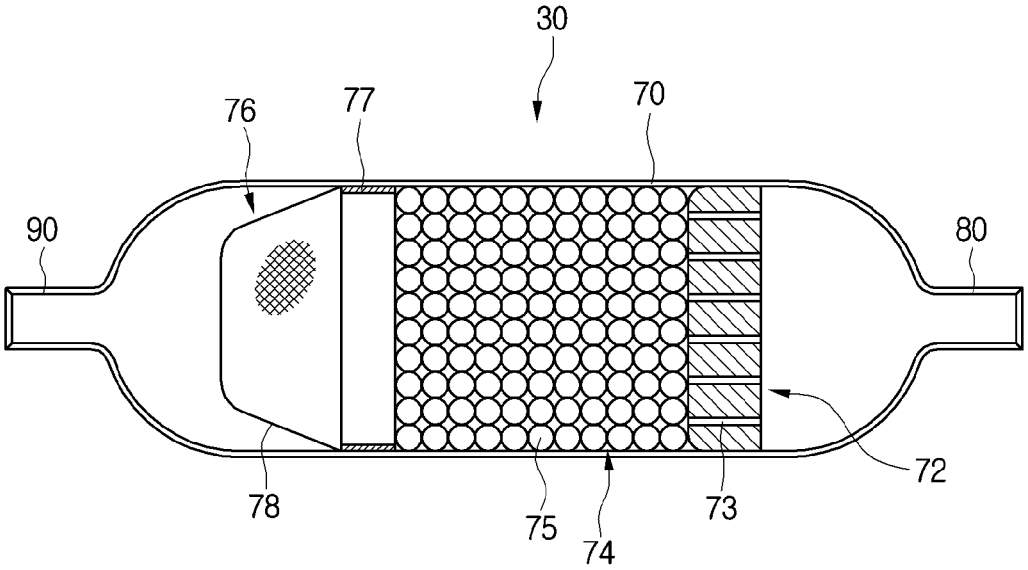
FIG. 2 is a view of a dryer of the refrigerator of FIG. 1

FIG. 2 is a view of a dryer of the refrigeration system of FIG. 1. Referring to FIG. 2, the dryer 30 may include a dryer body 70 that defines a flow space of the refrigerant a refrigerant inflow 80 disposed on or at a first side of the dryer body 70 to guide introduction of the refrigerant, and a refrigerant discharge 90 disposed on or at a second side of the dryer body 70 to guide discharge of the refrigerant. The dryer body 70 may have a long cylindrical shape, for example.

Dryer filters 72, 74, and 76 may be provided in the dryer body 70. In detail, the dryer filters 72, 74, and 76 may include a first dryer filter 72 disposed at a side of or adjacent to the refrigerant inflow 80, a third dryer filter 76 spaced apart from the first dryer filter 72 and disposed at a side of or adjacent to the refrigerant discharge 80, and a second dryer filter 74 disposed between the first dryer filter 72 and the third dryer filter 76. The first dryer filter 72 may be disposed adjacent to an inside of the refrigerant inflow 80, that is, disposed at a position closer to the refrigerant inflow 80 than the refrigerant discharge 90.

The first dryer filter 72 may have an approximately hemispherical shape. An outer circumferential surface of the first dryer filter 72 may be coupled to an inner circumferential surface of the dryer body 70. A plurality of through holes 73 to guide a flow of the refrigerant may be defined in the first dryer filer 72. A foreign substance having a relatively large volume may be filtered by the first dryer filter 72.

The second dryer filter 74 may include a plurality of adsorbents 75. Each of the plurality of adsorbents 75 may be a grain having a predetermined size. Each adsorbent 75 may be a molecular sieve and have a predetermined size of about 5 mm to about 10 mm.

A plurality of holes may be defined in each adsorbent 75. Each of the plurality of holes may have a size similar to that of oil (about 10 Å). The hole may have a size greater than a size (about 2.8 Å to about 3.2 Å) of the moisture and a size (about 4.0 Å in case of R134a, and about 4.3 Å in case of R600a) of the refrigerant. The term "oil" may refer to a working oil or cutting oil injected when components of the refrigeration cycle are manufactured or processed.

The refrigerant and moisture passing through the first dryer filter 72 may be easily discharged therethrough, even though the refrigerant and moisture are easily introduced into the plurality of holes while passing through the adsorbents 75. Thus, the refrigerant and moisture may not be easily adsorbed onto or into the adsorbents 75. However, if the oil is introduced into the plurality of holes, the oil may not be easily discharged, and thus, may be maintained in a state in which the oil is adsorbed onto or into the adsorbents 75.

For example, each adsorbent 75 may include a BASF 13X molecular sieve. A hole defined in the BASF 13X molecular sieve may have a size of about 10 Å (1 nm), and the BASF 13X molecular sieve may be expressed as a chemical formula: $Na_2O.Al_2O_3.mSiO_2.nH_2O$ ($m \leq 2.35$).

The oil contained in the refrigerant may be adsorbed onto or into the plurality of adsorbents 75 while passing through the second dryer filter 74.

Alternatively, the second dryer filter 74 may include an oil adsorbent paper or an adsorbent having a felt, instead of the plurality of adsorbents having a grain shape.

The third dryer filter 76 may include a coupling portion 77 coupled to an inner circumferential surface of the dryer body 70, and a mesh 78 that extends from the coupling portion 77 toward the refrigerant discharge 90. The third dryer filer 76 may be referred to as a mesh filter. A foreign substance having a fine size contained in the refrigerant may be filtered by the mesh 78.

Each of the first dryer filter 72 and the third dryer filter 76 may serve as a support to locate or position the plurality of adsorbents 75 within the dryer body 70. That is, discharge of the plurality of adsorbents 75 from the dryer 30 may be restricted by the first and third dryer filters 72 and 76.

As described above, the filters may be provided in the dryer 30 to remove foreign substances or oil contained in the refrigerant, thereby improving reliability of the refrigerant which acts as a gas bearing.

Hereinafter, a linear compressor according to an embodiment will be described in detail.

Figure 3:
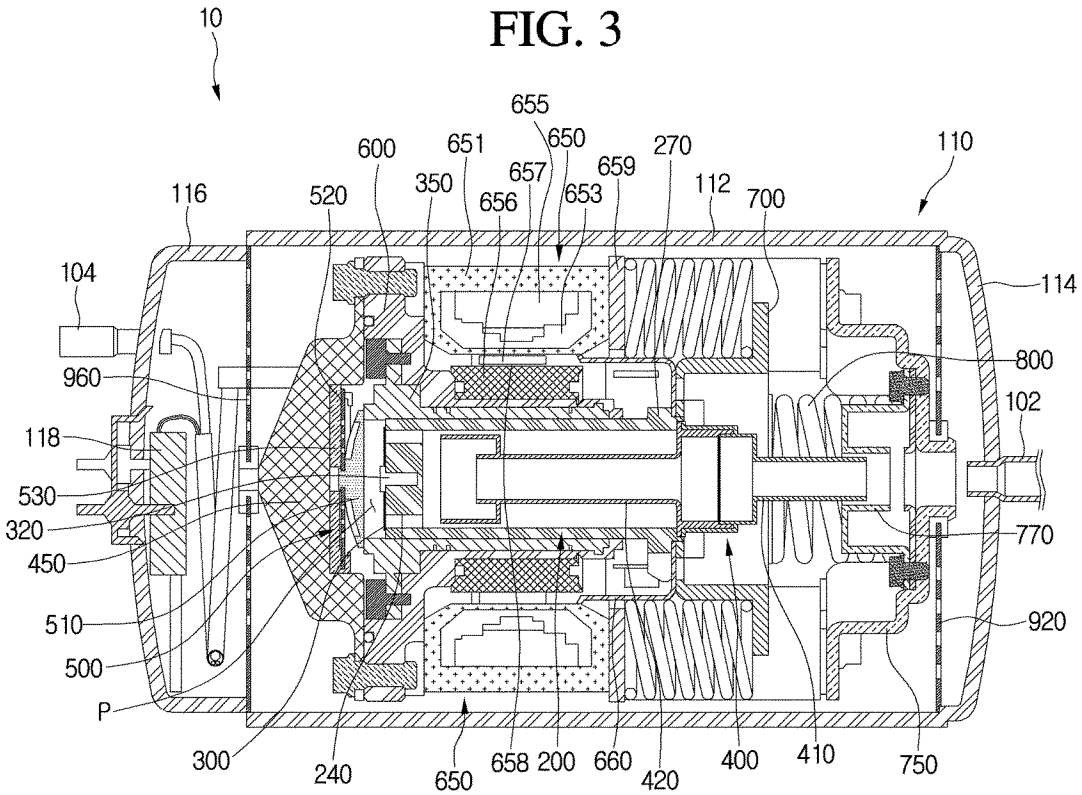
FIG. 3 is a cross-sectional view of a linear compressor of the refrigeration system of FIG. 1

FIG. 3 is a cross-sectional view of a linear compressor of the refrigeration system of FIG. 1. Referring to FIG. 3, the linear compressor 10 may include a suction inlet 102, a discharge outlet 104, a shell 110, a piston 200, a suction valve 300, a cylinder 350, a suction muffler 400, a discharge cover 450, a discharge valve assembly 500, a loop pipe 550, and a frame 600. The suction inlet 102 may introduce refrigerant into the shell 110 and may be mounted to pass through a first cover 114 of the shell 110. The discharge outlet 104 may discharge the compressed refrigerant from the shell 110 and may be mounted to pass through a second cover 116 of the shell 110.

The shell 110 may define an exterior of the linear compressor 10 and accommodate various components of the linear compressor 10. The shell 110 may include a shell body 112, the first cover 114, and the second cover 116.

The shell body 112 may have an approximately cylindrical shape. The shell body 112 may define the exterior of the linear compressor 10, in particular, a lateral exterior of the linear compressor 10. The shell body 112 may be manufactured using, for example, an iron plate having a thickness of about 2 T.

The first cover 114 may be mounted on or at a first side of the shell body 112. In this embodiment, the first cover 114 may be mounted on or at a right or first lateral side of the shell body 112. The suction inlet 102 may pass through the first cover 114 to introduce the refrigerant into the shell 110.

The second cover 116 may be mounted on or at a second side of the shell body 112. In this embodiment, the second cover 116 may be mounted on or at a left or second lateral side of the shell body 112, which is opposite to the first cover 114. The discharge outlet 104 may pass through the second cover 116 to discharge the compressed refrigerant.

The piston 200 may be disposed within the shell 110. The piston 200 may be linearly reciprocated within the cylinder 350, which will be described hereinbelow, along an axial direction of the shell 110 to compress the refrigerant introduced through the suction inlet 102. The term "axial direction" may refer to a reciprocating movement direction of the piston 200.

The piston 200 may be formed of a non-magnetic material, such as an aluminum material, such as aluminum or an aluminum alloy. As the piston 200 may be formed of the aluminum material, a magnetic flux generated in a motor assembly 650, which will be described hereinbelow, may not be transmitted into the piston 200, and thus, may be prevented from leaking outside of the piston 200. The piston 200 may be manufactured by a forging process, for example.

The suction valve 300 may be mounted at one side of the piston 200 to selectively open a refrigerant inlet 240 so that the refrigerant introduced from the piston 200 may be introduced into a compression space P, which will be described hereinbelow. The suction valve 300 may be mounted at the one side of the piston 200 by, for example, a coupling member 320, such as a screw.

The cylinder 350 may be mounted within the shell 110 to surround the piston 200. The cylinder 350 may be configured to accommodate at least a portion of the piston 200 and at least a portion of the suction muffler 400. Further, the cylinder 350 may form the compression space P, in which the refrigerant may be compressed due to reciprocating movement of the piston 220.

The cylinder 350 may be formed of a non-magnetic material, such as an aluminum material, such as aluminum or an aluminum alloy. The cylinder 350 and the piston 200 may have a same material composition, that is, a same kind and composition. As the cylinder 350 is formed of the aluminum material, magnetic flux generated in the motor assembly 650 may not be transmitted into the cylinder 350, and thus, may be prevented from leaking outside of the cylinder 350. The cylinder 350 may be manufactured by an extruding rod processing process, for example.

Also, as the cylinder 350 may be formed of the same material as the piston 200, the cylinder 350 may have a same thermal expansion coefficient as the piston 200. When the linear compressor 10 operates, a high-temperature (a temperature of about 100° C.) environment may be created within the shell 110. Thus, as the piston 200 and the cylinder 350 may have the same thermal expansion coefficient, the piston 200 and the cylinder 350 may be thermally deformed by a same degree. As a result, the cylinder 350 and the piston 200 may be thermally deformed with sizes and in directions different from each other to prevent the piston 200 from interfering with the cylinder 350 while the piston 200 moves.

The suction muffler 400 may reduce noise of the refrigerant and guide the refrigerant suctioned through the suction inlet 102 into the piston 200. The suction muffler 400 may include a first muffler 410 and a second muffler 420.

The first muffler 410 may be disposed within the shell 110 along an axial direction of the shell 110. The first muffler 410 may have a first end disposed within a suction guide 770, which will be described hereinbelow, and a second end coupled to the second muffler 420. A flow space, in which the refrigerant may flow, may be defined in the first muffler 410.

The second muffler 420 may be coupled to the first muffler 410 and may be disposed along the axial direction of the shell 110, like the first muffler 410. The second muffler 420 may have a first end coupled to the first muffler 410 and a second end disposed within the piston 200. Also, a flow space, in which the refrigerant may flow may be defined in the second muffler 420.

The discharge cover 450 may be disposed on or at a front side of the compression space P to form a discharge space or discharge passage of the refrigerant discharged from the compressor space P. The discharge cover 450 may be coupled and fixed to a front surface of a frame 600. The discharge cover 450 may be formed of a non-magnetic material, such as an aluminum material, such as aluminum or an aluminum alloy, like the cylinder 350.

The discharge valve assembly 500 may be disposed on a first side of the cylinder 350 to selectively discharge the compressed refrigerant into the discharge outlet 104 from the compression space P. The discharge valve assembly 500 may include a discharge valve 510, a valve spring 520, and a stopper 530.

The discharge valve 510 may be opened when a pressure of the compression space P is above a predetermined discharge pressure to introduce the refrigerant within the compression space P into the discharge space of the discharge cover 450. A rear portion or rear surface of the discharge valve 510 may be supported by a front surface of the cylinder 350.

The term "compression space P" may refer to a space defined between the suction valve 300 and the discharge valve 510. That is, the suction valve 300 may be disposed on or at first side of the compression space P, and the discharge valve 510 may be disposed on or at a second side of the compression space P, that is, a side opposite of the suction valve 300.

The valve spring 520 may be coupled to the discharge valve 510 and disposed between the discharge cover 450 and the discharge valve 510. The valve spring 520 may provide an elastic force in an axial direction, and may be a plate spring, for example.

The stopper 530 may support the valve spring 520 to restrict deformation of the valve spring 520. The stopper 530 may be seated on the discharge cover 450.

Thus, while the piston 200 is linearly reciprocated within the cylinder 350, when the pressure of the compression space P is below the predetermined discharge pressure and a predetermined suction pressure, the suction valve 300 may be opened to suction the refrigerant into the compression space P. On the other hand, when the pressure of the compression space P is above the predetermined suction pressure, the suction valve 300 may compress the refrigerant of the compression space P in a state in which the suction valve 300 is closed. When the pressure of the compression space P is above the predetermined discharge pressure, the valve spring 520 may be deformed to open the discharge valve 510. The refrigerant may be discharged from the compression space P into the discharge space of the discharge cover 450.

The loop pipe 550 may guide the compressed refrigerant from the discharge space to introduce the refrigerant into the discharge outlet 105. Thus, the loop pipe 550 may be coupled to the discharge cover 450 to extend to the discharge outlet 105. The loop pipe 550 may have a shape which is wound in a predetermined direction and extends in a rounded shape. The loop pipe 550 maybe coupled to the discharge outlet 105.

The frame 600 may fix the cylinder 350 to an inside of the shell 110. The frame 600 may be coupled to the cylinder 350 by a separate coupling member, for example. The frame 600 may be disposed to surround the cylinder 350. That is, the frame 600 may be disposed within the shell 110 to accommodate the cylinder 350 therein. The discharge cover 450 may be coupled to a front surface of the frame 600.

At least a portion of the high-pressure gaseous refrigerant discharged through the open discharge valve 510 may flow toward an outer circumferential surface of the cylinder 350 through a space at a portion at which the frame 600 is coupled to the cylinder 350. The refrigerant may be introduced into the cylinder 350 through a gas inflow and a nozzle, which may be defined in the cylinder 350. The introduced refrigerant may flow into a space between the piston 200 and the cylinder 350 to allow an outer circumferential surface of the piston 200 to be spaced apart from an inner circumferential surface of the cylinder 350. Thus, the introduced refrigerant may serve as a "gas bearing" that reduces friction between the piston 200 and the cylinder 350 while the piston 200 is reciprocated.

The linear compressor 10 may include a motor assembly 650, a support 700, a back cover 750, a suction guide 770, a plurality of springs 800, and plate springs 920 and 960. The motor assembly 650 may provide a drive force to linearly reciprocate the piston 200. The motor assembly 650 may include outer stators 651, 653, and 655, an inner stator 656, one or more permanent magnet 657, a fixing member 658, and a stator cover 659.

The outer stators 651, 653, and 655 may be fixed to the frame 600 and disposed to surround the cylinder 350. The outer stators 651, 653, and 655 may include coil winding bodies 651 and 653, and a stator core 655. The coil winding bodies 651 and 653 may include a bobbin 651, and a coil 653 wound in a circumferential direction of the bobbin 651. The coil 653 may have a polygonal cross-section, for example, a hexagonal cross-section. The stator core 655 may be manufactured by stacking a plurality of laminations in a circumferential direction thereof and be disposed to surround the coil winding bodies 651 and 653.

The inner stator 656 may be spaced inward from the outer stators 651, 653, and 655 and fixed to an outer circumference of the cylinder 350. The inner stator 656 may be manufactured by stacking the plurality of laminations in the circumferential direction thereof, like the stator core 655.

The one or more permanent magnet 657 may be coupled to the piston 200 by a connection member 660. More particularly, the connection member 660 may be coupled to a piston flange 270, which will be described hereinbelow, and then, may be bent to extend toward the permanent magnet 657. As the permanent magnet 657 is reciprocated, the piston 200 may be reciprocated together with the permanent magnet 657 in the axial direction.

The fixing member 658 may firmly maintain a coupled state between the permanent magnet 657 and the connection member 660 and be disposed to surround an outside of the permanent magnet 657. The fixing member 658 may be formed of a composition in which a glass fiber or carbon fiber is mixed with a resin.

The stator cover 659 may support the outer stators 651, 653, and 655 and be disposed on or at one side of the outer stator 651, 653, and 655. A first side of the outer stators 651, 653, and 655 may be supported by the stator cover 659, and a second side of the outer stators 651, 653, and 655 may be supported by the frame 600.

The support 700 may support the piston 200. The support 700 may be coupled to the piston flange 270 and the connection member 660 by a predetermined coupling member, for example.

The suction guide 770 may guide the refrigerant suctioned in through the suction inlet 102 to introduce the refrigerant into the suction muffler 400. An end of the first muffler 410 of the suction muffler 400 may be disposed inside the suction guide 770.

The back cover 750 may be disposed inside the shell 110 and be disposed close to the suction inlet 102. The back cover 750 may be coupled to the suction guide 770, and also, may be spring-coupled to the support 700.

The plurality of springs 800 may allow the piston 200 to perform a resonant motion. A natural frequency of each of the plurality of springs 800 may be adjusted. The plurality of springs 800 may include a first spring supported between the stator cover 659 and the support 700, and a second spring supported between the support 700 and the back cover 750.

Plate springs 920 and 960 may support inner components of the linear compressor 10 with respect to the shell 110, and be, respectively, disposed on both sides of the shell body 112. The plate springs 920 and 960 may include a first plate spring 920, and a second plate spring 960.

The first plate spring 920 may be coupled to the first cover 114. For example, the first plate spring 920 may be disposed to be inserted into a portion at which the shell body 112 is coupled to the first cover 114.

The second plate spring 960 may be coupled to the second cover 116. For example, the second plate spring 960 may be disposed to be inserted into a portion at which the shell body 112 is coupled to the second cover 116.

Hereinafter, a coupling relationship between the cylinder 350 and the frame 600 of the linear compressor 10 according to an embodiment will be described in hereinbelow.

Figure 4:
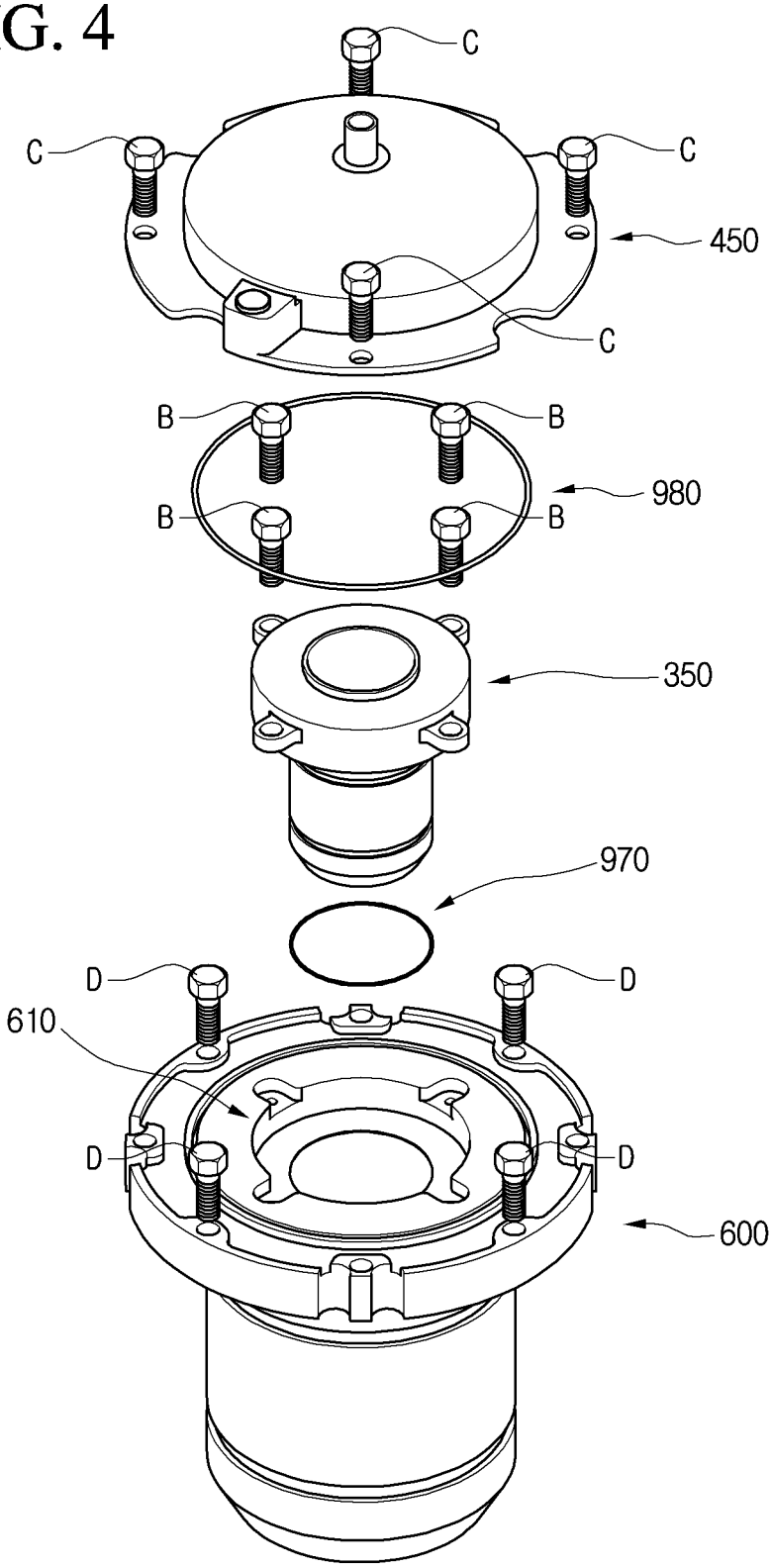
FIG. 4 is an exploded perspective view of main components of the linear compressor of FIG. 3.
Figure 5:
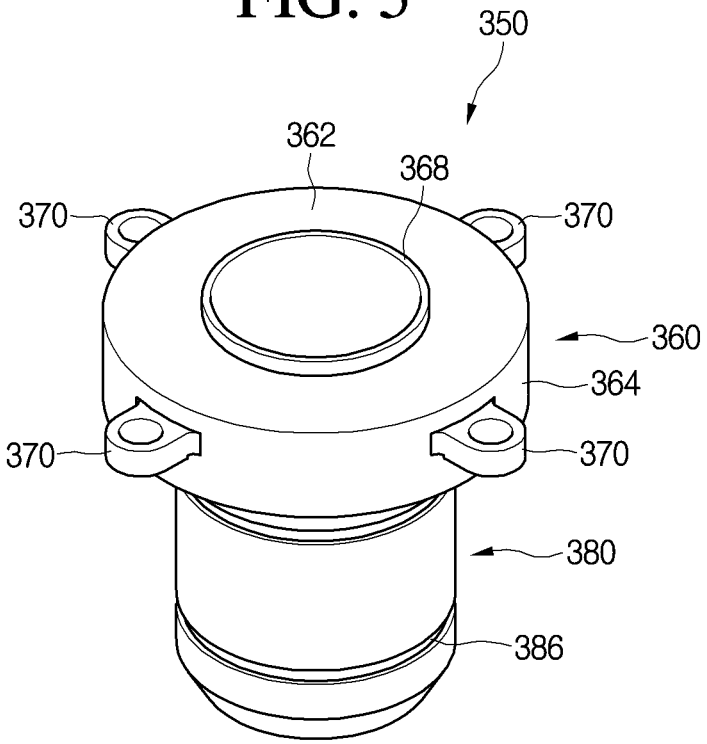
FIG. 5 is a perspective view of a cylinder of the linear compressor of FIG. 3.
Figure 6:
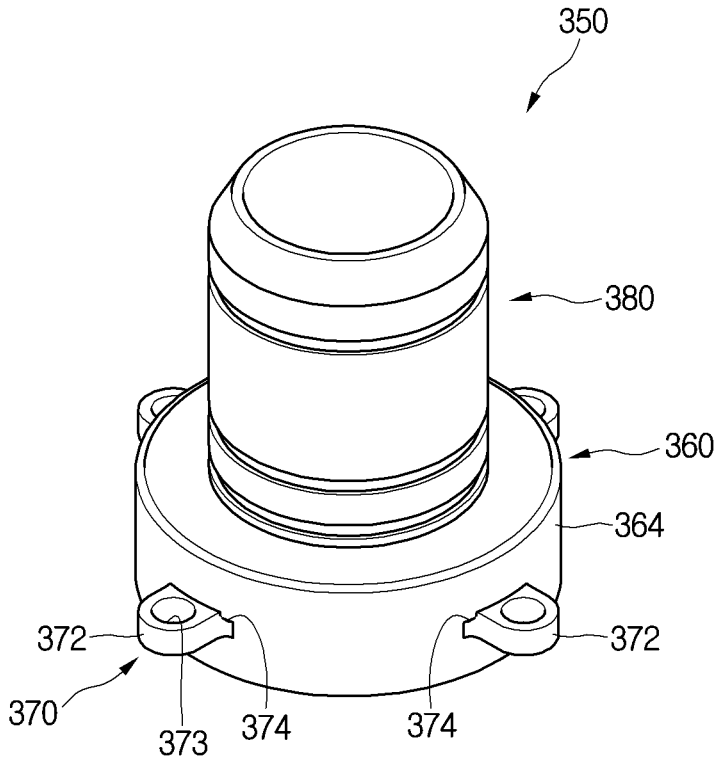
FIG. 6 is a bottom perspective view of the cylinder of FIG. 5.
Figure 7:
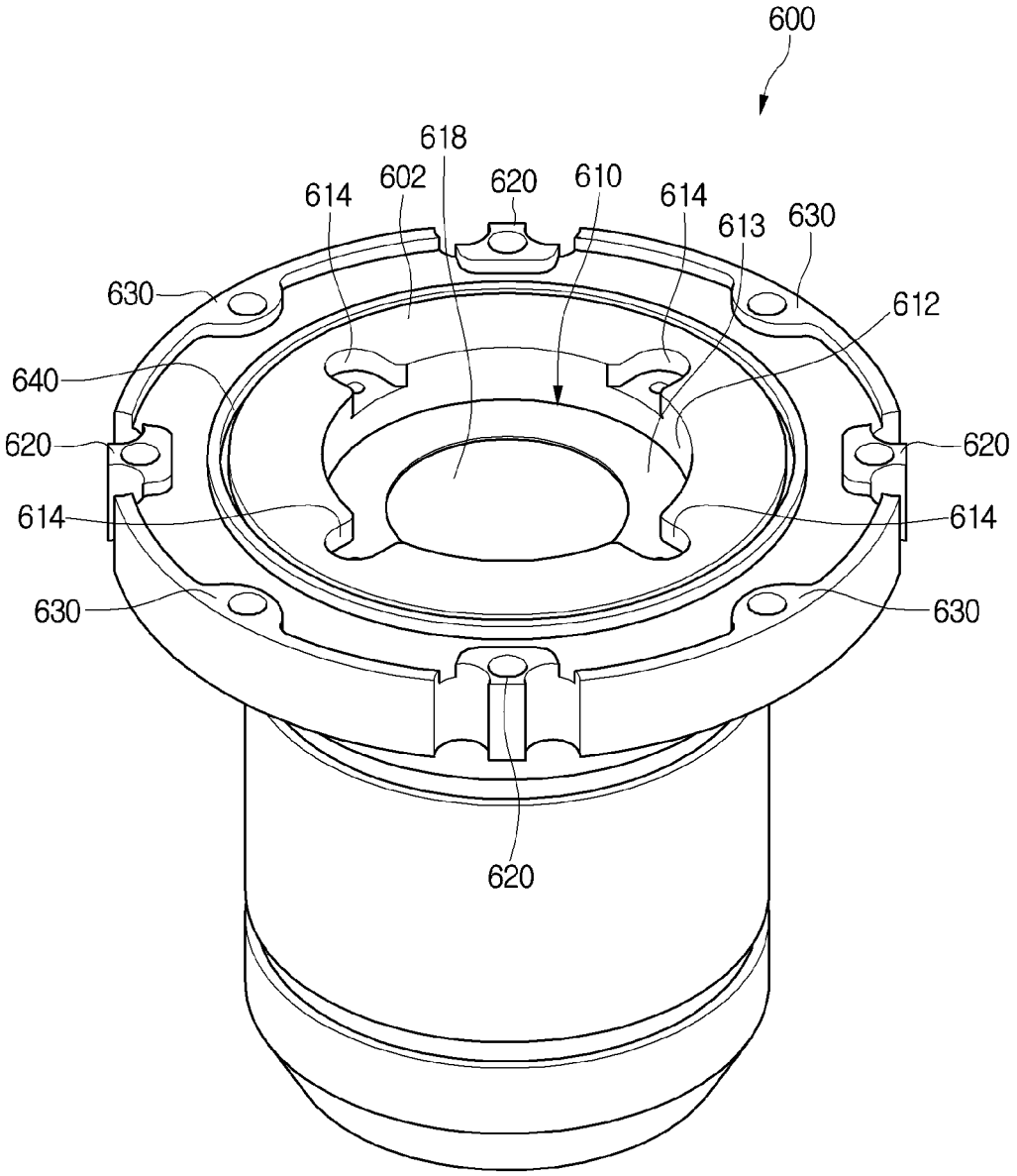
FIG. 7 is a perspective view of a frame of the linear compressor of FIG. 3.
Figure 8:
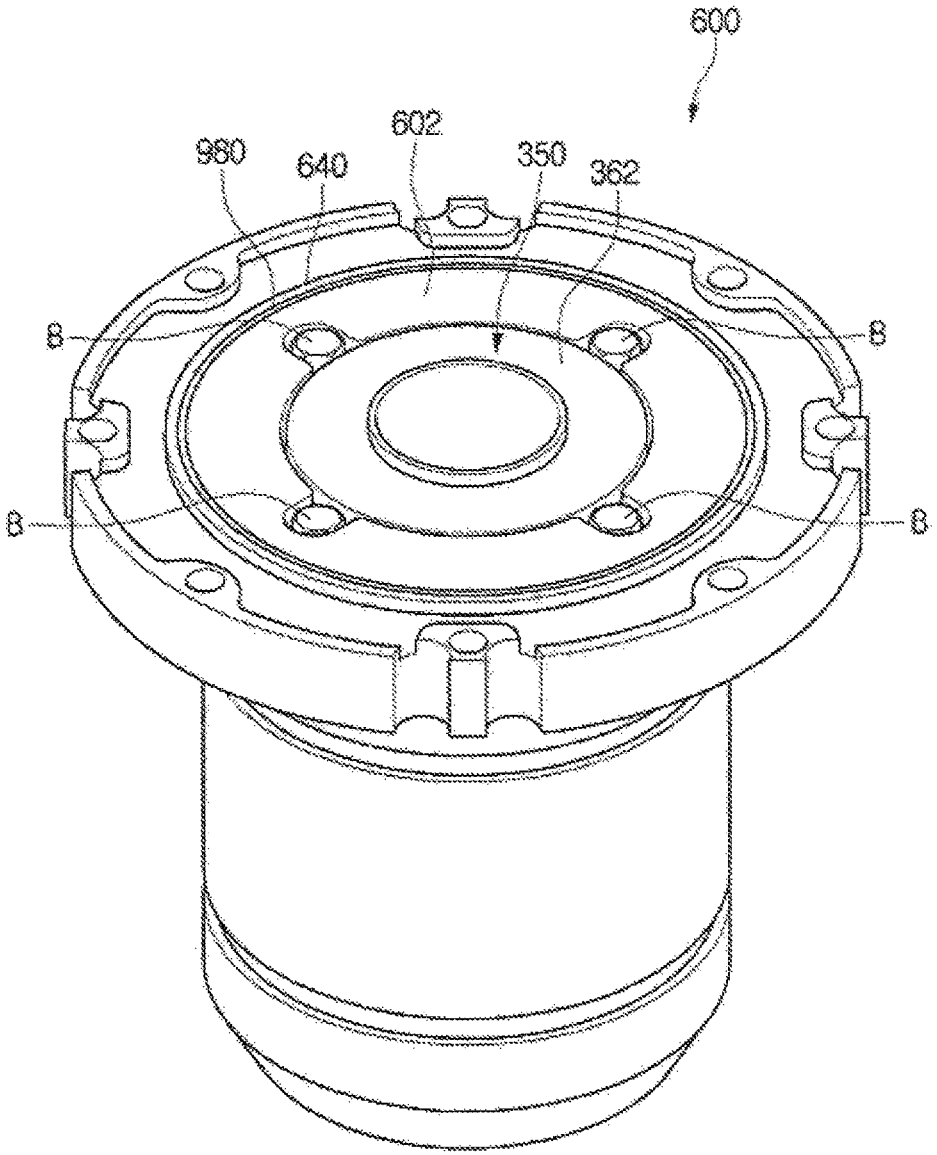
FIG. 8 is a perspective view of the cylinder mounted on the frame of FIG. 7.
Figure 9:
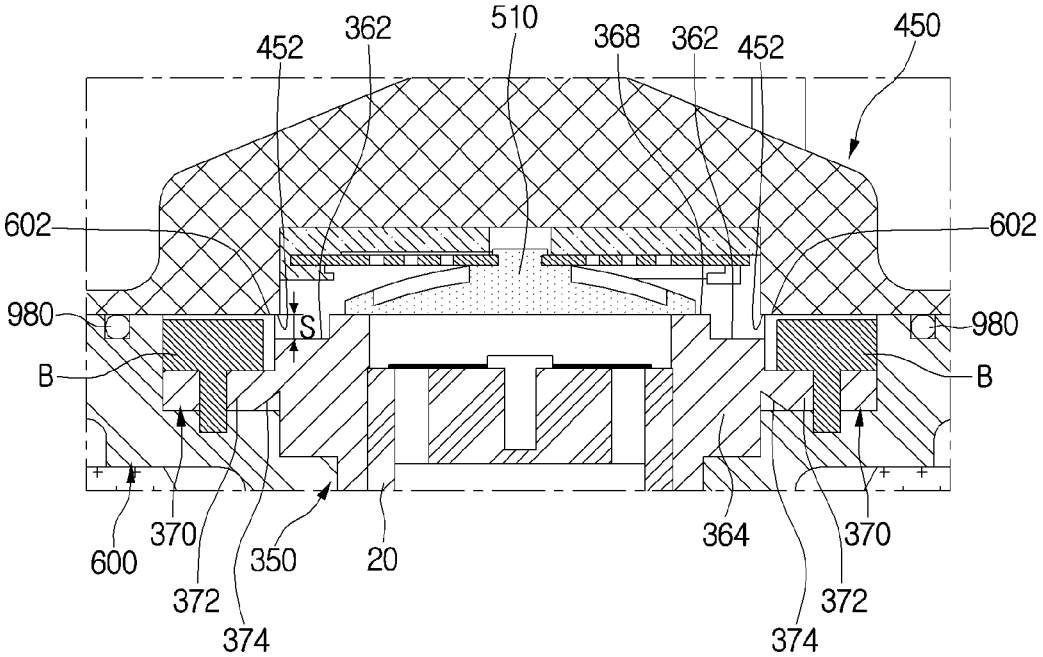
FIG. 9 is a cross-sectional view illustrating main components of the linear compressor of FIG. 3.
Figure 10:
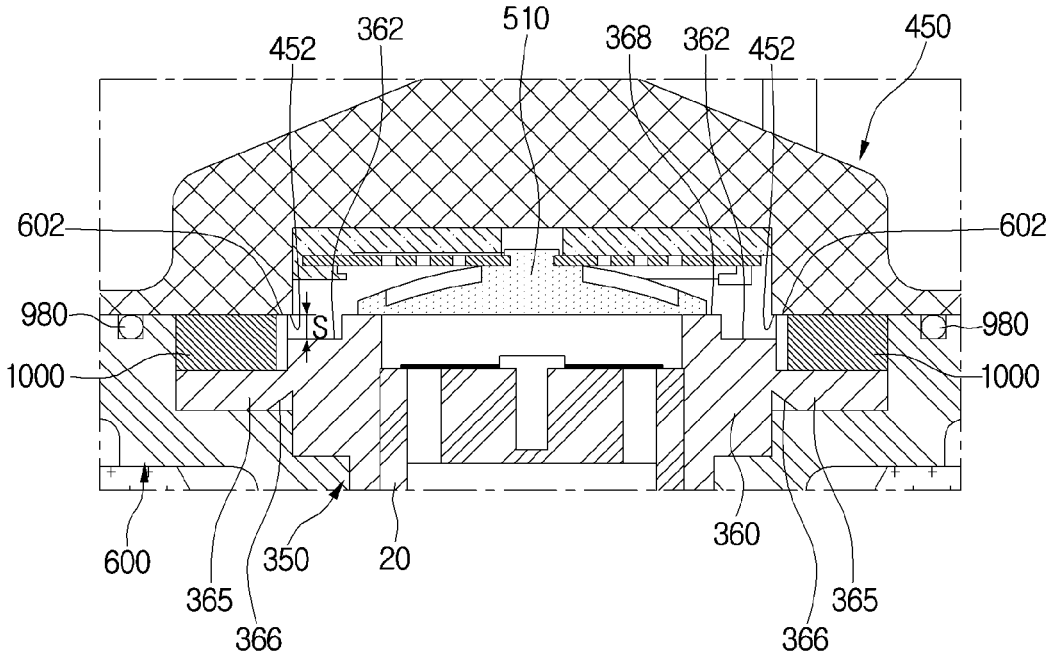
FIG. 10 is a cross-sectional view of main components of the linear compressor of FIG. 3 according to another embodiment.

FIG. 4 is an exploded perspective view of main components of the linear compressor of FIG. 3. FIG. 5 is a perspective view of a cylinder of the linear compressor of FIG. 3. FIG. 6 is a bottom perspective view of the cylinder of FIG. 5. FIG. 7 is a perspective view of a frame of the linear compressor of FIG. 3. FIG. 8 is a perspective view of the cylinder mounted on the frame of FIG. 7. FIG. 9 is a cross-sectional view of main components of the linear compressor of FIG. 3. FIG. 10 is a cross-sectional view of main components of the linear compressor of FIG. 3 according to another embodiment.

Referring to FIGS. 4 to 9, the cylinder 350 may include a cylinder head 360, and a cylinder body 380. The cylinder head 360 may be disposed to face the discharge cover 450, and may have an approximately cylinder shape having an inner hollow. The cylinder head 360 may include a circular rib 368, and a plurality of coupling member through hole portions 370.

The circular rib 368 may protrude from a front surface 362 of the cylinder head 360. The circular rib 368 may openably support the discharge valve 510, which may be disposed within the discharge cover 450.

A coupling member B, which will be described hereinbelow, may pass through the plurality of coupling member through hole portions 370, and each of the plurality of coupling member through hole portions 370 may protrude from a side surface 364 of the cylinder head 360. The cylinder 350 may be coupled to the frame 600 by, for example, four coupling members B, as shown in this embodiment. However, this is merely illustrative, and thus, a number of coupling member through portion holes may be changed according to design.

The plurality of coupling member through hole portions 370 may be spaced a predetermined distance from each other in a circumferential direction of the cylinder head 360. More particularly, the plurality of coupling member through hole portions 370 may be disposed at an angle of about 90° along the circumferential direction of the cylinder head 360. Each of the plurality of coupling member through hole portions 370 may include a through hole body 372, and a coupling force transmission preventer 374.

Each of the coupling members B may pass through the through hole body 372. For this, a through hole 373, through which the coupling member B may pass, may be defined in the through hole body 372.

The coupling force transmission preventer 374 may minimize a force transmitted in a radial direction of the cylinder 350 when the cylinder 350 and the frame 600 are coupled to each other by the coupling member B. The coupling force transmission preventer 374 may extend from the through hole body 372, and may be inclined toward a side surface of the cylinder head 360.

The cylinder body 380 may extend from the cylinder head 360 in a longitudinal direction of the cylinder 350. The cylinder body 380 may have a cylindrical shape having an outer diameter less than an outer diameter of the cylinder head 360. The cylinder body 380 may have an inner hollow having a same size as a size of the cylinder head 360 to communicate with the cylinder head 360. The piston 200 may be mounted in the inner hollow.

An O-ring mount groove 386, on which an O-ring 970 to prevent the refrigerant from leaking, may be defined in a side surface of the cylinder body 360. The O-ring mount groove 386 may have a predetermined depth along a circumferential direction of the cylinder body 380.

The frame 600 may include a cylinder mount 610, a plurality of discharge cover mounts 620, a plurality of motor assembly mounts 630, and an O-ring mount 640. The cylinder mount 610 may be configured to mount the cylinder 350 within the frame 600. Thus, the cylinder mount 610 may pass through a center of the frame 600 along an axial direction of the frame 600. The cylinder mount 610 may include a first mount groove 612, and a second mount groove 618.

The first mount groove 612 may have a predetermined depth recessed from a front surface 602 of the frame 600 in the circumferential direction of the frame 600. The first mount groove 612 may accommodate the cylinder head 360 of the cylinder 350 when the cylinder 350 is mounted.

A depth of the first mount groove 612, that is, a length of the first mount groove 612 may be less than a length of the side surface 364 of the cylinder head 360. Thus, when the cylinder 350 is mounted in the first mount groove 612 of the cylinder head 360, the front surface 362 of the cylinder head 360 may not extend beyond the front surface 602 of the frame 600. More particularly, an edge of the front surface 362 of the cylinder head 360 may be stepped at a height less than a height of the front surface 602 of the frame 600. As a result, the front surface 362 of the cylinder head 360 may be disposed to be spaced a predetermined distance S from a back surface 452 of the discharge valve 450 facing the front surface 362. Thus, as the cylinder 350 does not contact the discharge cover 450 when the cylinder 350 is mounted on the frame 600, it may prevent the cylinder 350 from metal-contacting the discharge cover 450.

A plurality of coupling member mount grooves 614, on which the plurality of coupling members B may be mounted, may be defined in the first mount groove 612. As four coupling members B are provided in this embodiment, four coupling member mount grooves 614 may be formed. However, a number of coupling member mount grooves 614 may be changed according to design in consideration of a number of coupling members N coupled thereto.

Each of the coupling member mount grooves 614 may be disposed to be spaced apart from each other at an angle of about 90° along the circumferential direction of the first mount groove 612 to correspond to each of the coupling member through hole portions 370. Each of the coupling member mount grooves 614 may be stepped from a bottom surface 613 of the first mount groove 612 within the first mount groove 612 to accommodate the through hole body 372 of the coupling member through hole portion 370.

The second mount grove 618 may extend from the first mount groove 612 to have a predetermined depth in a longitudinal direction of the frame 600. The second mount groove 618 may accommodate the cylinder body 380 of the cylinder 350 when the cylinder 350 is mounted.

The plurality of discharge cover mounts 620 may be configured to couple the discharge cover 450 to the frame 600. The plurality of discharge cover mounts 620 may be coupled to a plurality of coupling members C that passes through the discharge cover 450, respectively.

The plurality of discharge cover mounts 620 may be spaced a predetermined distance from each other on an edge of the front surface 602 in the circumferential direction of the frame 600. In this embodiment, four discharge cover mounts are provided. However, embodiments are not limited thereto, and thus, a number of discharge cover mounts 620 may be changed according to design.

The plurality of motor assembly mounts 630 may be configured to couple the frame 600 to the motor assembly 650. The plurality of motor assembly mounts 630 may receive a plurality of coupling members D coupled to the motor assembly 650, respectively.

The plurality of motor assembly mounts 630 may be spaced a predetermined distance from each other on or along an edge of the front surface 602 in the circumferential direction of the frame 600. In this embodiment, four motor assembly mounts 630 are provided. However, embodiments are not limited thereto, and a number of motor assembly mounts 630 may be changed according to design.

The four motor assembly mounts 630 and the four discharge cover mounts 620 may be alternately disposed with respect to each other. That is, one discharge cover mount 620 may be disposed between two motor assembly mounts 630, and one motor assembly mount 630 may be disposed between two discharge cover mounts 620.

The O-ring mount 640 may be disposed on the front surface 602 of the frame 600 in the circumferential direction of the frame 600. The O-ring mount 640 may have a predetermined depth from the front surface 602 of the frame 600 so that the O-ring 980 that prevents refrigerant from leaking may be mounted on the O-ring mount 640.

As described above, as the cylinder 350 is mounted to be spaced a predetermined distance S from the discharge cover 450, the cylinder 350 may not be affected by a force pushing from the discharge cover 350, unlike a method in which the cylinder is mounted on the frame 600 due to compression from the discharge cover 450 according to the related art. Thus, in the cylinder 350 according to this embodiment, deformation of an inner wall of the cylinder 350, which is generated by the force pushing from the discharge cover 450 and transmitted in the axial direction of the cylinder 350 may be solved.

Further, in the cylinder 350 according to this embodiment, an external force transmitted toward the inner wall of the cylinder 350 due to the coupling of the cylinder 350 and the frame 600 by the coupling member(s) B may also be minimized through the coupling force transmission preventer 374 as described above. That is, a volume of the through hole body 372 in the radial direction of the cylinder 350 may be reduced by the coupling force transmission preventer 374 to reduce an intensity of the external force transmitted in the direction of the inner wall of the cylinder 350 by a reduced volume. Thus, in this embodiment, when the cylinder 350 and the frame 600 are coupled to each other through the coupling member(s) B, deformation of the inner wall of the cylinder may also be minimized. Thus, the linear compressor 10 according to this embodiment may prevent the inner wall of the cylinder 350 from being deformed by the mounting of the discharge cover 450.

As illustrated in FIG. 10, coupling member B may include at least one support rib 1000 that contacts the discharge cover 450 to allow the cylinder 350 to be supported by the frame 600. The support rib 1000 may be closely attached to the discharge cover 450 disposed on a support rib seat 365, which may be disposed on each of both side surfaces of the cylinder head 360. Thus, the cylinder 350 may be supported on the frame 600 by a force from the discharge cover 450. As the force is substantially similar to the coupling force in the previous embodiment, the cylinder 350 and the frame 600 may be firmly coupled to each other.

The support rib 1000 may be mounted on the support rib seat 365 as a separate rib member or be integrated with the support rib seat 365. Like the previous embodiment, the coupling force transmission preventer 374, which may be inclined toward the side surface of the cylinder head 360 to minimize the force transmitted in the radial direction of the cylinder 350 may be disposed on the support rib seat part 365.

As described above, the coupling member B may be provided as a rib structure, such as the support rib 1000 according to this embodiment, in addition to the screw member, such as a bolt, according to the previous embodiment.

According to various embodiments, a linear compressor capable of preventing an inner wall of the cylinder from being deformed and a refrigeration system including a linear compressor may be provided.

Embodiments disclosed herein provide a linear compressor capable of preventing an inner wall of a cylinder from being deformed and a refrigeration system including a linear compressor.

Embodiments disclosed herein provide a linear compressor that may include a suction port or inlet, through which a refrigerant may be introduced; a discharge part or outlet, through which the refrigerant may be discharged; a cylinder disposed within a shell to accommodate a piston reciprocated to compress the refrigerant introduced through the suction part; a frame that accommodates the cylinder, the frame being mounted inside the shell; and a discharge cover coupled to a front surface of the frame to discharge the refrigerant compressed by the piston into the discharge part. A front surface of the cylinder that faces the discharge cover may be spaced a predetermined distance from the discharged cover.

A front edge of the cylinder may be stepped at a height less than a height of the front surface of the frame. The cylinder may be coupled to the frame through at least one coupling member.

A cylinder mount part or mount, on which the cylinder may be mounted to pass therethrough, may be disposed on the frame, and the cylinder may be mounted on the cylinder mount part through or by the at least one coupling member. The cylinder mount part may include a first mount groove having a predetermined depth from the front surface of the frame in a circumferential direction of the frame, and a second mount groove that extends from the first mount groove in a longitudinal direction of the frame to have a predetermined depth.

The cylinder may include a cylinder head accommodated in the first mount groove, and a cylinder body that extends from the cylinder head in the longitudinal direction of the cylinder. The cylinder body may be accommodated in the second mount groove. A side surface of the cylinder head in the longitudinal direction may have a length less than a length of the first mount groove.

At least one coupling member mount groove, on which the at least one coupling member may be mounted, may be defined in the first mount groove, and at least one coupling member through part or hole, through which the at least one coupling member may pass, may be disposed on a side surface of the cylinder head. The at least one coupling member through part may include a through part body, through which the at least one coupling member may pass, and a coupling force transmission prevention part or preventer that extends from the through part body toward the side surface of the cylinder head. The coupling force transmission prevention part may be inclined upward from the cylinder head.

The at least one coupling member may include a plurality of coupling members, and the coupling member mount groove and the coupling member through part may be provided to correspond to the plurality of coupling members. The plurality of coupling member mount grooves may be spaced a predetermined distance from each other along a circumferential direction of the first mount groove, and the plurality of coupling member through parts may be spaced a predetermined distance from each other along a circumferential direction of the cylinder head to correspond to the plurality of coupling member mount grooves. The plurality of coupling members may include four coupling members.

The at least one coupling member may include a support rib disposed on the side surface of the cylinder to contact the discharge cover so that the cylinder is supported by the frame. The support rib may be integrated with the side surface of the cylinder.

According to another embodiment, a refrigeration system may include a linear compressor according to embodiments.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell including:

a shell body;

a first cover defined at a first end of the shell body; and a second cover defined at a second end of the shell body;

a frame provided inside of the shell;

a cylinder accommodated in the frame and fixed to the frame by at least one coupling member, the cylinder defining a compression space and including:

a cylinder head;

a circular rib protruding from a front surface of the cylinder head;

a cylinder body extending from a rear surface of the cylinder head in a longitudinal direction which is defined as a direction from the first cover to the second cover; and a plurality of coupling member through hole portions extending radially from a side surface of the cylinder head, and spaced apart from each other circumferentially along the side surface of the cylinder head;

a piston received inside of the cylinder and configured to reciprocate in the longitudinal direction to compress a refrigerant in the compression space;

a discharge cover coupled to a front surface of the frame to define a discharge space; and a discharge valve received in the discharge space and separably mounted on the circular rib to selectively open or dose the compression space, wherein a diameter of the cylinder head is larger than a diameter of the cylinder body, and wherein the frame includes a cylinder mount to accommodate the cylinder, the cylinder mount including:

a first mount recess having a predetermined depth from the front surface of the frame in the longitudinal direction and having a diameter corresponding to the diameter of the cylinder head to receive the cylinder head; and a second mount recess extending from the first mount recess in the longitudinal direction and having a diameter corresponding to the diameter of the cylinder body to accommodate the cylinder body, and wherein a length of the cylinder head in the longitudinal direction is less than the depth of the first mount recess, such that the front surface of the cylinder head is configured to be spaced a predetermined distance from the front surface of the frame.

2. The linear compressor of claim 1, wherein the frame further includes a plurality of coupling member mount grooves which are respectively recessed from the front surface of the frame to respectively receive the plurality of coupling member through hole portions, wherein the plurality of coupling member mount grooves is formed at an edge of the first mount recess, and spaced apart from each other circumferentially around the first mount recess, and wherein a depth of each coupling member mounting groove from the front surface of the frame is less than the depth of the first mounting recess from the front surface of the frame.

3. The linear compressor of claim 1, wherein each of the plurality of coupling member through hole portions includes:

a through hole body having a through hole; and a coupling force transmission preventer that extends from the through hole body towards the side surface of the cylinder head.

4. The linear compressor of claim 3, wherein the coupling force transmission preventer is inclined toward the front surface of the cylinder head from the side surface of the cylinder head.

5. The linear compressor of claim 2, wherein a front surface of each coupling member through hole portion is offset from the front surface of the cylinder head in the longitudinal direction.

6. The linear compressor of claim 2, wherein a thickness of each coupling member through hole portion in the longitudinal direction is less than the depth of the coupling member mounting groove.

7. The linear compressor of claim 1, wherein a front surface of the circular rib and the front surface of the frame are coplanar.

8. A refrigeration system comprising the linear compressor according to claim 1.

* * * * *